US005575201A

United States Patent [19]

Fenner et al.

[11] Patent Number: 5,575,201

[45] Date of Patent: Nov. 19, 1996

[54] COMPACTOR HAVING AN AUGER AND METHOD OF ITS OPERATION

[75] Inventors: Grant H. Fenner, Memphis, Tenn.; Kent Spiers, Caledonia, Miss.; Peter C. Nelson, Reform, Ala.

[73] Assignee: Marathon Equipment Company, Vernon, Ala.

[21] Appl. No.: 428,758

[22] Filed: Apr. 25, 1995

[51] Int. Cl.[6] ..... B30B 13/00; B30B 9/30; B30B 7/00

[52] U.S. Cl. ..... 100/39; 100/97; 100/139; 100/145; 100/229 A; 241/260.1; 241/DIG. 38; 414/501; 414/526

[58] Field of Search ..... 100/39, 94–98 R, 100/137–140, 145, 229 A; 414/501, 503, 525.6, 526; 241/260.1, DIG. 38

[56] References Cited

U.S. PATENT DOCUMENTS

| | | | |
|---|---|---|---|
| 649,413 | 5/1900 | Luzzatto | 100/98 R |
| 713,791 | 11/1902 | Orman | 100/145 |
| 3,550,527 | 12/1970 | Sinitsin et al. | 100/97 |
| 3,555,996 | 1/1971 | Schwarz et al. | 100/39 |
| 3,625,138 | 12/1971 | Shinn et al. | 100/97 |
| 3,651,755 | 3/1972 | Gati | 100/96 |
| 3,683,796 | 8/1972 | Miner et al. | 100/145 |
| 3,956,815 | 5/1976 | Pitt | 100/39 |
| 3,966,129 | 6/1976 | Brewer | 241/79.1 |
| 4,227,849 | 10/1980 | Worthington | 414/526 |
| 4,253,615 | 3/1981 | Koenig | 241/36 |
| 4,256,035 | 3/1981 | Newfeldt | 100/145 |
| 4,303,010 | 12/1981 | Coffey | 100/100 |
| 4,640,659 | 2/1987 | Parks | 100/98 R |
| 4,852,817 | 8/1989 | Tipton | 241/260.1 |
| 4,915,308 | 4/1990 | Koenig | 241/152 R |
| 4,938,426 | 7/1990 | Koenig | 241/222 |
| 4,951,884 | 8/1990 | Koenig | 241/101.2 |
| 4,993,649 | 2/1991 | Koenig | 241/224 |
| 5,088,422 | 2/1992 | Koenig | 110/173 R |
| 5,108,040 | 4/1992 | Koenig | 241/260.1 |
| 5,217,173 | 6/1993 | Koenig | 241/33 |
| 5,263,425 | 11/1993 | Koenig | 110/173 C |
| 5,269,472 | 12/1993 | Koenig | 241/33 |
| 5,308,003 | 5/1994 | Koenig | 241/260.1 |
| 5,322,009 | 6/1994 | Retrum | 100/139 |
| 5,351,899 | 10/1994 | Koenig | 241/260.1 |
| 5,353,687 | 10/1994 | Koenig | 92/61 |
| 5,373,923 | 12/1994 | Koenig | 188/382 |
| 5,386,770 | 2/1995 | De Boer | 100/177 |
| 5,390,592 | 2/1995 | Schnell et al. | 100/127 |
| 5,481,851 | 1/1996 | Koenig | 53/432 |
| 5,484,112 | 1/1996 | Koenig | 241/236 |

FOREIGN PATENT DOCUMENTS

| | | | |
|---|---|---|---|
| 0220936 | 5/1987 | European Pat. Off. | 414/501 |
| 54-98059 | 8/1979 | Japan | 100/229 A |
| 63-277103 | 11/1988 | Japan | 414/526 |
| 8401063 | 11/1985 | Netherlands | 100/145 |

OTHER PUBLICATIONS

Sani–Tech Systems, Inc., Sani–Tech Refuse Compactors, no date.

*Primary Examiner*—Stephen F. Gerrity
*Attorney, Agent, or Firm*—Joseph W. Berenato, III

[57] ABSTRACT

A compactor assembly comprises a ground supported housing having an open top through which waste material is deposited. An auger is rotatable on an axis positioned within the housing for breaking waste material received therein through the open top, and for transporting the waste material therethrough. A drop area is downstream of the receiving chamber of the housing and has a remote open portion. A compactor ram is reciprocal on an axis parallel to the auger axis for transferring waste material through the open portion. A first drive is operably associated with the auger for rotating the auger, and a second drive is operably associated with the compactor ram for causing reciprocation thereof.

39 Claims, 6 Drawing Sheets

COMPACTOR HAVING AN AUGER AND METHOD OF ITS OPERATION

FIELD OF THE INVENTION

The disclosed invention is to a compactor and method of its operation in which material to be compacted is first broken by a rotating auger to a reduced size and thereafter compacted by operation of a reciprocal ram. More specifically, the disclosed invention is directed to a compactor and method of operation in which a ground supported material-receiving housing has an auger rotating therein for breaking material and forwarding same to a drop area, with a reciprocal ram being operably associated with the drop area for transferring the broken material into a container in which the broken material is compacted by the ram.

BACKGROUND OF THE INVENTION

Various forms of compactors are utilized for increasing the quantity of material in a container which subsequently is to be emptied, so that the material may be landfilled, recycled, or otherwise handled. A typical compactor has a housing or hopper in which the waste material is deposited, and an associated container. The container may be separable or it may be fixed. A reciprocating ram is normally utilized for transferring the waste material from the housing to the container, so that subsequent actuations of the ram will cause the material in the container to become compacted and thereby permit increased quantities of material to be held.

Many types of material are not suitable for compaction, however. For example, pallets, couches and other furniture, refrigerators or other white goods, and other large bulky items heretofore have been collected by vehicles which leave the materials in an unchanged condition. Most landfills charge a "tipping fee" each time a vehicle, such as a waste collection vehicle, deposits material. The bulky materials occupy relatively large volumes of space, thus necessitating more loads than may otherwise be required by their weight, and therefore increased tipping fees need to be paid.

The bulky materials noted above usually are large, not dense. They have not heretofore been subject to compaction, however, because of their materials of construction, size, and other physical constraints. Compaction of these materials would seem to be beneficial in order to increase the amount of material a given transport vehicle could hold, with the result that tipping fees and transportation costs would be reduced. Businesses, municipalities, and others are continuously seeking to reduce their disposal costs, so compaction of bulky materials is one mechanism for minimizing those costs.

There is a need for a compactor assembly which would compact large bulky items in order to permit a lesser number of transport vehicles to be utilized for transporting a given number of bulky items. The disclosed invention meets that need by providing a low speed, rotating auger which breaks the material into reduced sized portions, and then transports the material by continued rotation. Same is thereafter compacted by a reciprocating ram transferring the material to a container.

OBJECTS AND SUMMARY OF THE INVENTION

The primary object of the disclosed invention is a compactor and method of its operation in which a rotating auger initially breaks large bulky materials into reduced sized portions and transports the materials to a drop area, at which point transfer to and compaction in a container by a reciprocating hydraulic ram occurs.

A compactor assembly comprises a ground supported housing having a receiving chamber with an open top through which waste material is deposited. An auger is rotatable on an axis and is positioned within the housing for breaking waste material received therein through the open top, and for transporting the waste material therefrom. A drop area is downstream of the receiving chamber and has a first open portion communicating with the chamber for receiving waste material, and a second remote open portion communicating with a container. A compactor ram is reciprocal on an axis parallel to the auger axis for transferring the waste material from the drop area through the second open portion into the container. A first drive is operably associated with the auger for rotating the auger, and a second drive is operably associated with the compactor ram for causing reciprocation thereof.

A compactor assembly comprises a ground supported housing having an open top communicating with a receiving chamber. An auger is rotatable on an axis for breaking material deposited into the receiving chamber through the open top, and for transporting the deposited material therefrom. The auger comprises a shaft having a material-breaking helix formed thereabout. A drop area is downstream of the receiving chamber and receives material broken by the helix of the auger. A compactor ram is operably associated with the drop area and is reciprocal therein for transferring waste material therefrom into an associated container. A first drive is operably associated with the shaft for causing rotation thereof, and a second drive is operably associated with the compactor ram for causing reciprocation thereof.

The method of breaking and compacting bulky materials comprises the step of providing a compactor assembly comprising a rotary auger for breaking and transporting material contacted therewith, a drop area for receiving the broken material, a reciprocating ram operably associated with the drop area for discharging the broken material, and a container in which the broken material is thereafter received for compaction by reciprocation of the ram. The rotating auger is contacted with material, and thereby the material is caused to be broken. The broken material is transported to the drop area by continued rotation of the auger. Reciprocation of the ram occurs, and thereby the broken material is discharged into the container.

These and other objects and advantages of the invention will be readily apparent in view of the following description and drawings of the above described invention.

DESCRIPTION OF THE DRAWINGS

The above and other objects and advantages and novel features of the present invention will become apparent in the following detailed description of the preferred embodiment of the invention illustrated in the accompanying drawings, wherein.

DESCRIPTION OF THE INVENTION

Figures 1, 2:
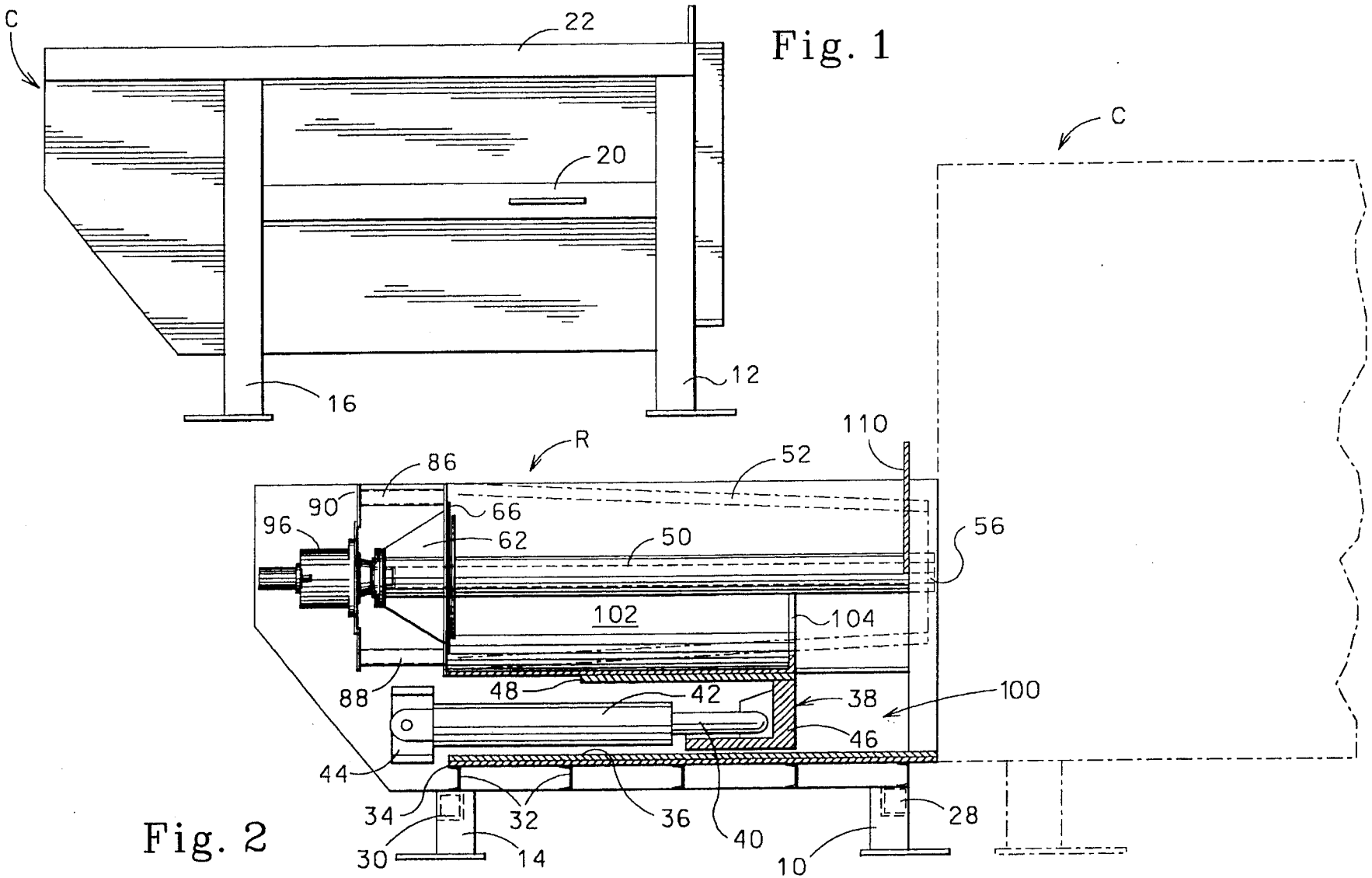
FIG. 1 is a side elevational view of the compactor assembly of the invention.
FIG. 2 is a side elevational view partially in section of the compactor assembly of FIG. 1 and an attached container.
Figure 6:
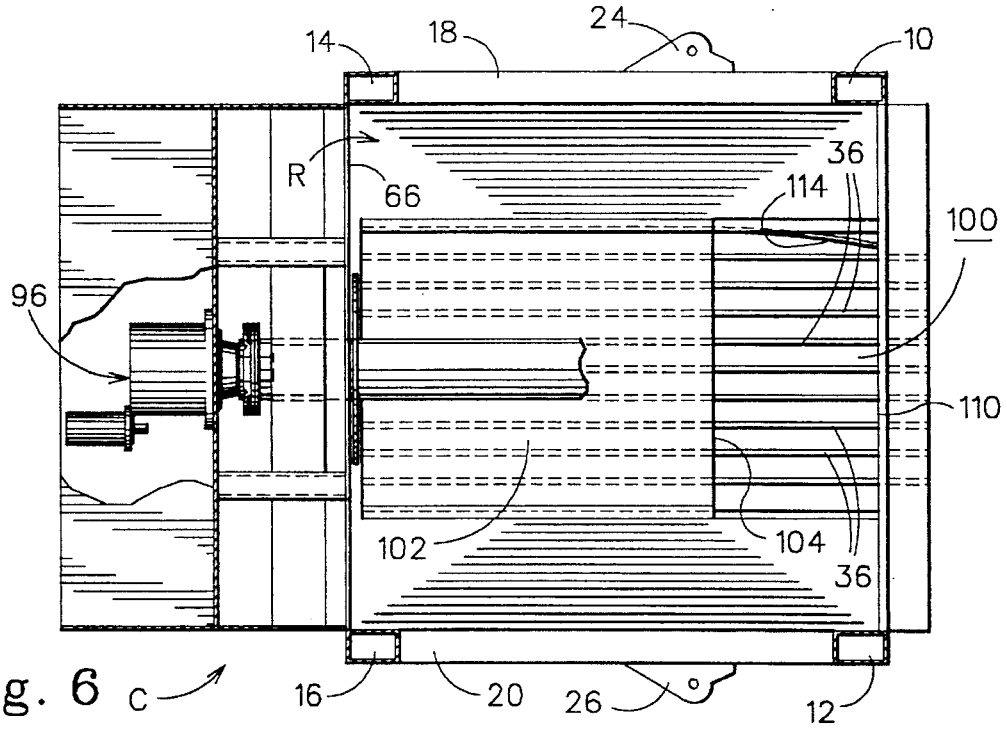
FIG. 6 is a top plan view of the compactor assembly of FIG. 1.

Compactor assembly C, as best shown in FIGS. 1 and 6, comprises vertically disposed tubular legs 10, 12, 14, and 16 which are ground supported and which are interconnected by braces 18 and 20. Top supports 22 and 23 interconnect the upward terminus of legs 12 and 16 and legs 10 and 14, respectively. The legs, braces, and top supports provide a rigid framework housing within which the operating components of the compactor assembly C may be received. Preferably lugs 24 and 26 are secured to the braces 18 and 20, respectively, to permit the compactor assembly C to be firmly secured in operative association with a container unit U, as best shown in FIG. 2. The container unit U may be a roll on/roll off type unit, and typically is separable from the compactor assembly C to permit the container U to be transported to and dumped at a waste facility, such as a landfill. The compactor assembly C may, however, be utilized with an integral container.

Figure 4:
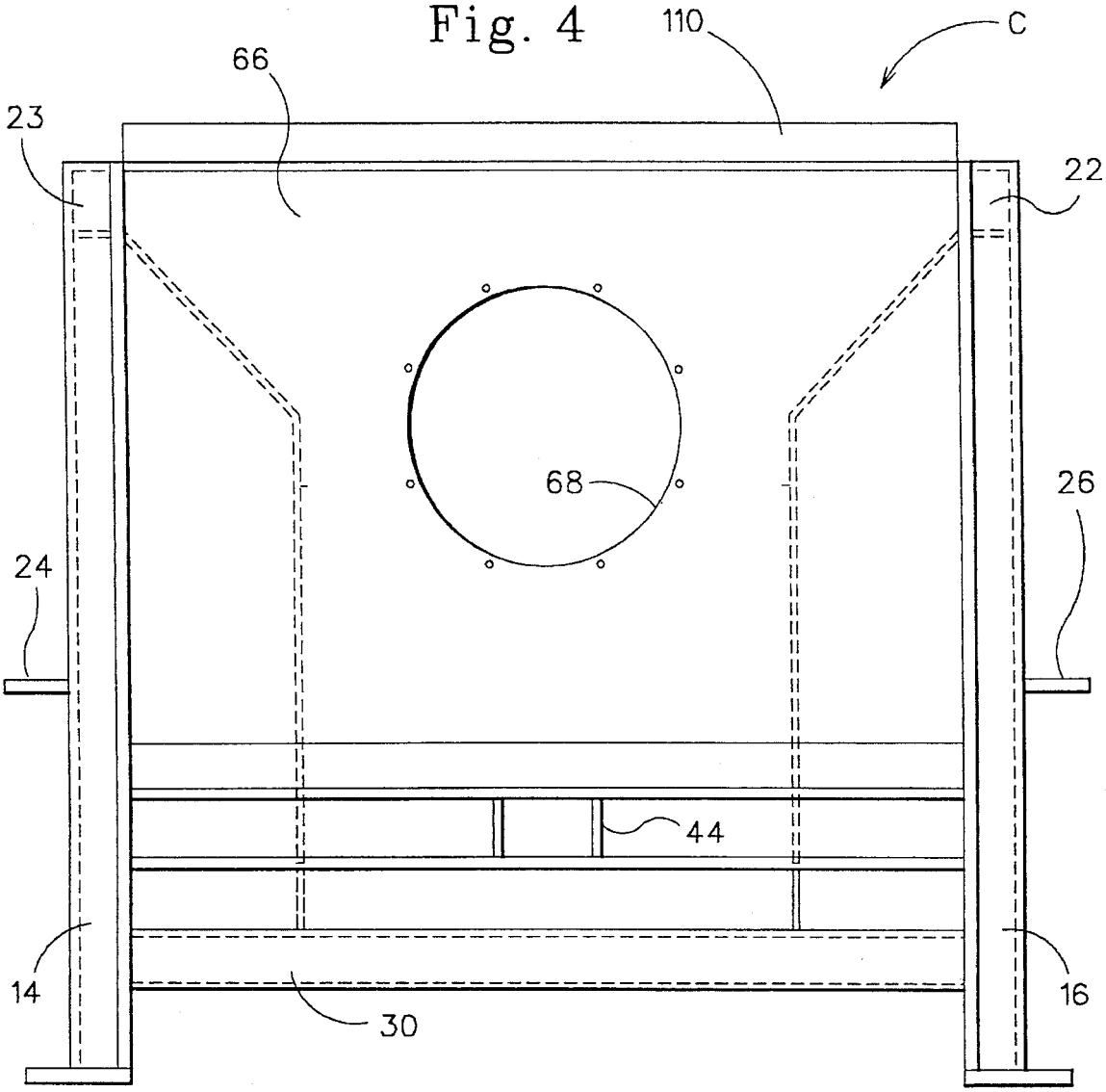
FIG. 4 is a rear elevational view of the compactor assembly of FIG. 1.
Figure 5:
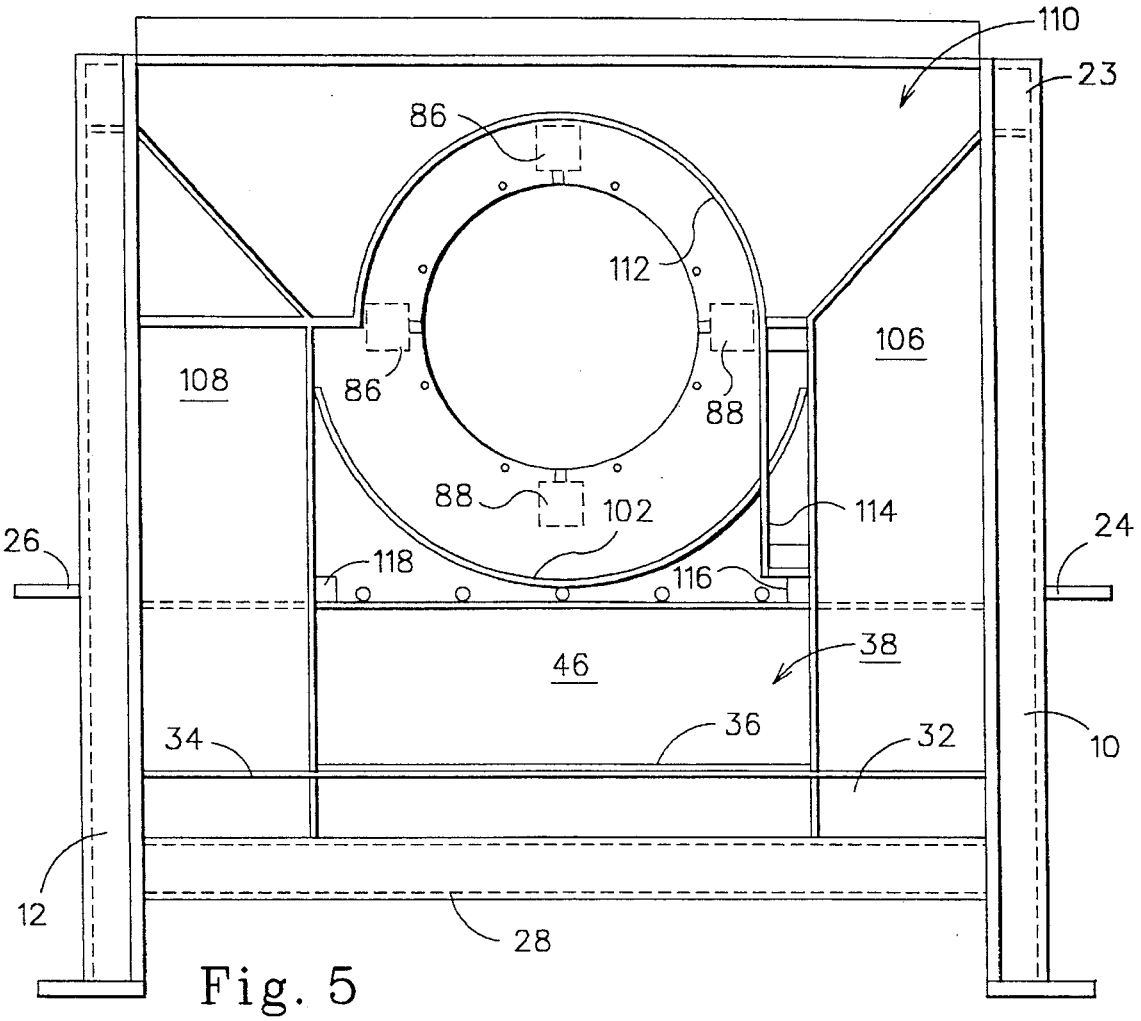
FIG. 5 is a front elevational view of the compactor assembly of FIG. 1.

Tubes 28 and 30 interconnect the lower portions of the legs 10 and 12, and 14 and 16, respectively, as best shown in FIGS. 2 and 4–5. Channels 32 extend parallel to the tubes 28 and 30 between the legs 10, 12 and 14, 16 and are overlaid by plate 34. Plate 34 is welded to the channels 32 to provide support therefor and to provide a flat surface upon which tongue and groove flooring members 36 may be overlaid, as best shown in FIG. 6. Flooring members 36 extend in parallel and provide a surface upon which ram 38 rides while being reciprocated by piston 40 of hydraulic cylinder 42 journaled to bracket 44. Ram 38 has a forward substantially vertical face 46 and an upper rearwardly extending plate 48 acting as a gate valve when the ram 38 is reciprocated by the piston 40 during operation of the compactor assembly C.

Figure 3:
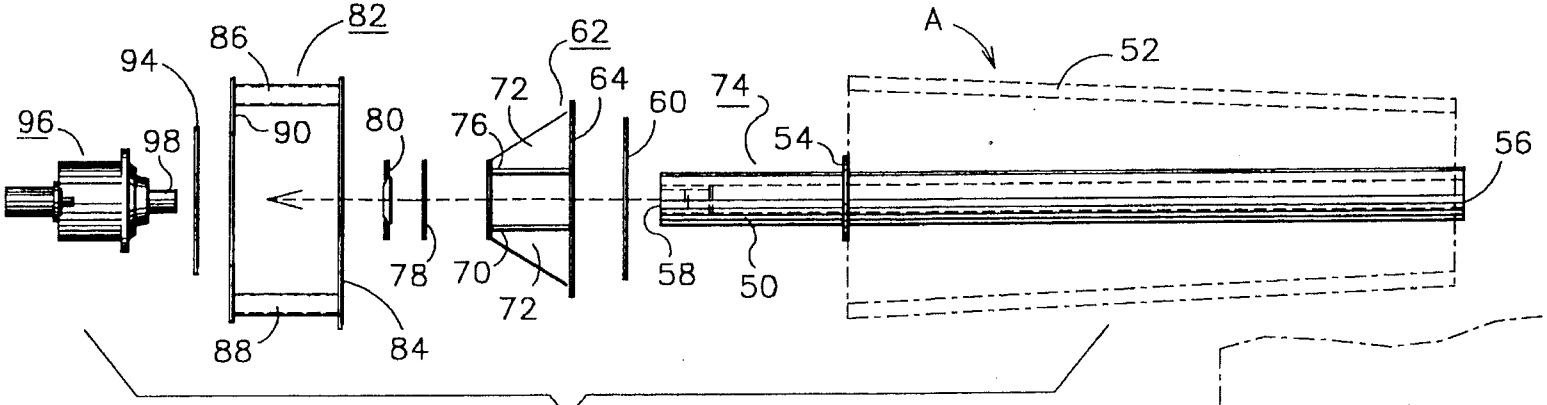
FIG. 3 is an enlarged assembly drawing of the auger of the invention.
Figure 2A:
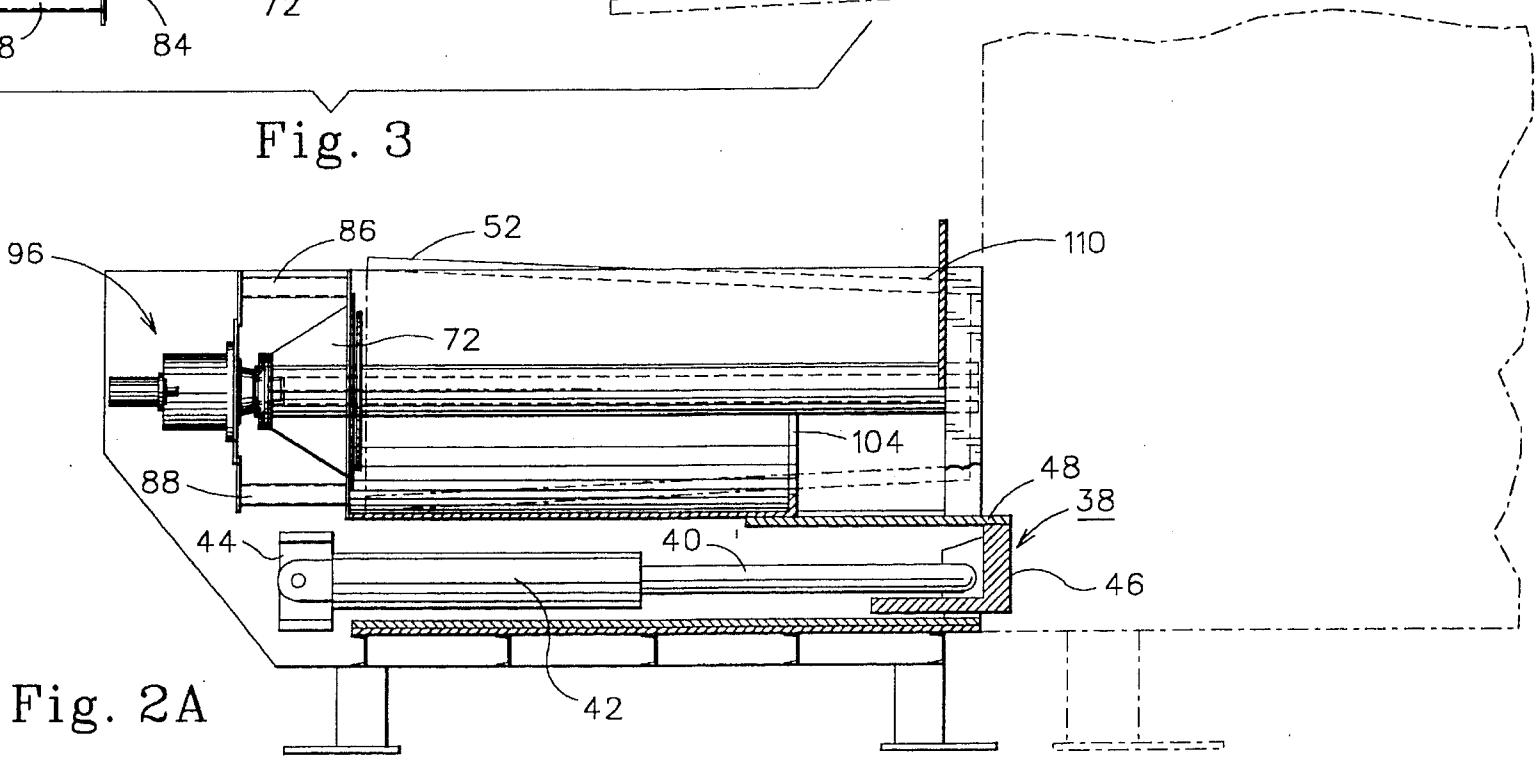
FIG. 2*a* is a side elevational view according to FIG. 2 illustrating the ram of the compactor assembly in the extended position.

Auger A, as best shown in FIG. 3, comprises a hollow, thick-walled steel shaft 50 to which screw-like material-breaking helix 52 is welded. Annular steel plate 54 is welded to shaft 50 to prevent helix 52 from moving relative to shaft 50 during rotation thereof. Helix 52, as best shown in FIGS. 2, 2A, and 3, tapers from a larger diameter at plate 54 to a lesser diameter at the distal end 56 of shaft 50. Helix 52 terminates short of distal end 56. Helix 52 is oriented on shaft 50 so that clockwise rotation causes material to be transported thereby from adjacent plate 54 toward distal end 56. Splined coupling 58 is secured within shaft 50.

Thrust bearing 60 is annular in form and is mounted about shaft 50 for engagement with plate 54. We prefer that the thrust bearing 60 be a high density synthetic material, such as nylon, to provide lubricity during rotation of plate 54 with shaft 50. The thrust bearing 60 may, preferably, be manufactured from Nylatron™. Bearing assembly 62 has an annular plate 64 which is securable to rear wall 66 of compactor assembly C, as best shown in FIG. 2, by bolting or like attachment. Rear wall 66 has an opening 68 therein, as best shown in FIG. 4, through which composite cylindrical bearing 70 and bracing flanges 72 extend. We prefer that the bearing 70 have an outer steel composition, with the inner surface formed of bronze and about which Teflon® or like substance is deposited. The proximal end portion 74 of shaft 50 extends through the cylindrical opening of bearing 70, with the bronze and Teflon permitting rotation of the shaft 50. Bearing assembly 62 terminates in annular plate 76.

Retaining washer 78 is annular and disposed about proximal end 74 of shaft 50 and against plate 76. Retaining washer 78 also is preferably formed of Nylatron or other high density synthetic material. Shaft retainer 80 is bolted to shaft 50 and bears against retaining washer 78. Shaft retainer 80 resembles a disk brake rotor, and prevents the shaft 50 from moving toward distal end 56 as shaft 50 is rotated.

Body sections 82, as best shown in FIG. 3, are bolted to the rearward surface of rear wall 66, as best shown in FIGS. 2. Each of body sections 82 includes a plate 84 from which tubular members 86 and 88 extend parallel to shaft 50. Annular bracket plate 90 is welded to the rearward ends of tubular members 86 and 88, respectively. While only one body section 82 is illustrated in FIG. 3, two such body sections 82 are provided and are offset relative to each other by 90°. Mounting plate 94 is welded to the body sections 82 at bracket plate 90, as best shown in FIG. 2.

Hydraulic motor and gear box assembly 96 is bolted to mounting plate 94 and has a coupling element 98 received within splined coupling 58 of shaft 50. Motor and gear box assembly 96 preferably is a power take-off device of the type used in all-terrain vehicles for driving the axles thereof. The motor and gear box assembly 96 preferably rotates its coupling element 98 at 8.5 revolutions per minute based upon 18 gallons per minute of pumped hydraulic fluid. The motor and gear box assembly 96 rotates the shaft of coupling element 98 concentric with the axis of rotation of shaft 50.

The cylindrical bearing 70 cooperates with the shaft 50 to journal the shaft 50 to rearwall 66 in a manner minimizing possible damage to motor and gear box assembly 96. The materials to be broken by auger A can be large and bulky, thereby applying a substantial moment to the shaft 50. The cylindrical bearing 70, however, has sufficient length to preclude the shaft 50 from damaging the motor and gear box assembly 96 when large, bulky materials are being broken. Thus, the motor and gear box assembly 96 can continue to rotate the shaft 50 even though the material being broken has or is attempting to bend the shaft 50 off its axis of rotation.

Compactor assembly C, as best shown in FIGS. 2 and 6, has a receiving chamber R with an open top in which material to be broken by auger A is deposited. Receiving chamber R extends from rear wall 66 forwardly toward drop area 100 along which flooring members 36 extend. Receiving chamber R has an arcuate floor surface 102 which terminates at 104, so that waste broken by rotation of auger A and transported therealong will fall into drop area 100 for being moved therefrom by reciprocation of ram 38. It can be seen in FIG. 2 that the helix 52 extends above top supports 22 and 23 and yet is very close to floor surface 102. The floor surface 102 effectively divides the receiving chamber R into an upper portion in which auger A rotates, and a lower portion in which ram 38 reciprocates.

As best shown in FIG. 5, front supports 106 and 108 are secured respectively to legs 10 and 12 and are spaced apart. Breaker plate 110 is secured to top supports 22 and 23 and the upper angled surfaces of front supports 106 and 108. Breaker plate 110 has an arcuate surface 112 which cooperates with front supports 106 and 108 to provide an opening through broken waste may be transported by rotation of auger A. It can be seen in FIG. 2 that distal end 56 of shaft 50 extends beyond breaker plate 110 and its arcuate surface 112 to assure that waste is transported into container U. The breaker plate 110 helps to break large waste components by forcing same against the surface 112 as the auger A rotates in a clockwise rotation and as ram 38 is reciprocated.

We prefer that a funnel section 114 be provided adjacent front support 106, as best shown in FIGS. 5 and 6, in order to direct waste toward the opening provided by surface 112 and supports 106 and 108. We have found that the funnel section 114 facilitates direction of waste through the opening provided thereby when auger A is rotated in the clockwise direction as viewed in FIG. 5. Also illustrated in FIG. 5 are steel hold-down rods 116 and 118 secured to the front supports 106 and 108, respectively, and bearing upon plate 48 of ram 38 to maintain vertical orientation of the ram 38 during its reciprocation.

Figure 7:
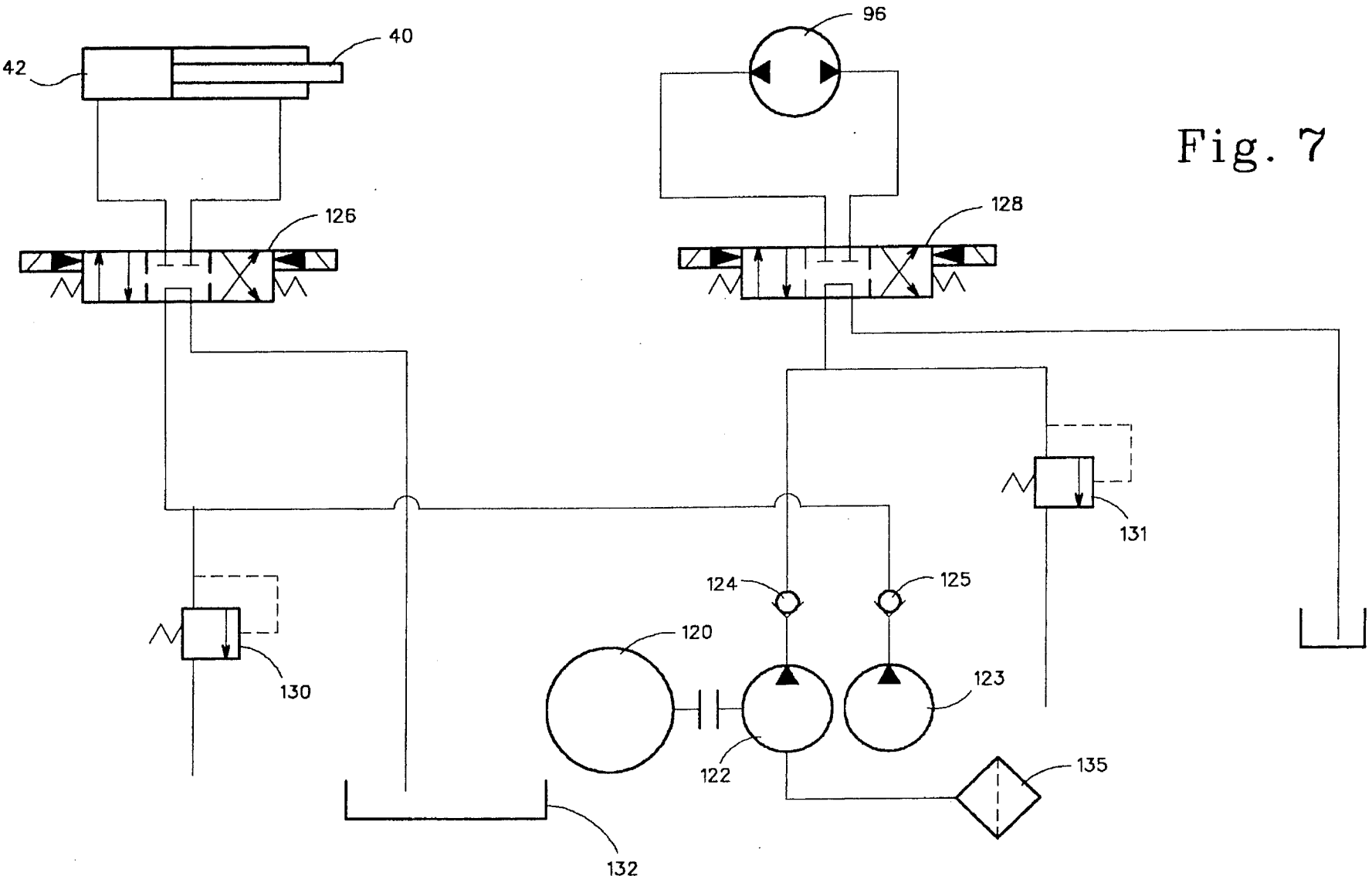
FIG. 7 is a schematic view of the hydraulic system of the invention.

We prefer that the ram 38 continuously reciprocate as the auger A is rotated. Rotation of the auger A by motor and gearbox assembly 96 consumes 18 gallon per minute of hydraulic fluid, with reciprocation of the ram requiring three gallons per minute. We therefore provide electric motor 120 operating pumps 122 and 123 which supply hydraulic fluid through check valves 124 and 125 to directional control valves 126 and 128. Directional control valve 126 supplies pressurized hydraulic fluid to cylinder 42 for reciprocating piston 40. Directional control valve 128, on the other hand, supplies pressurized hydraulic fluid to motor and gearbox assembly 96 for causing the shaft 50 to be rotated. The directional control valves 126 and 128 cause continuous reciprocation of ram 38 during clockwise rotation of auger A, although manual controls are provided to permit ram 38 to be selectively reciprocated and also for permitting auger A to be rotated counterclockwise, should that be necessary. The hydraulic circuit of FIG. 7 furthermore provides relief valves 130 and 131, an hydraulic reservoir 132, and suction strainer 135.

Figure 8:
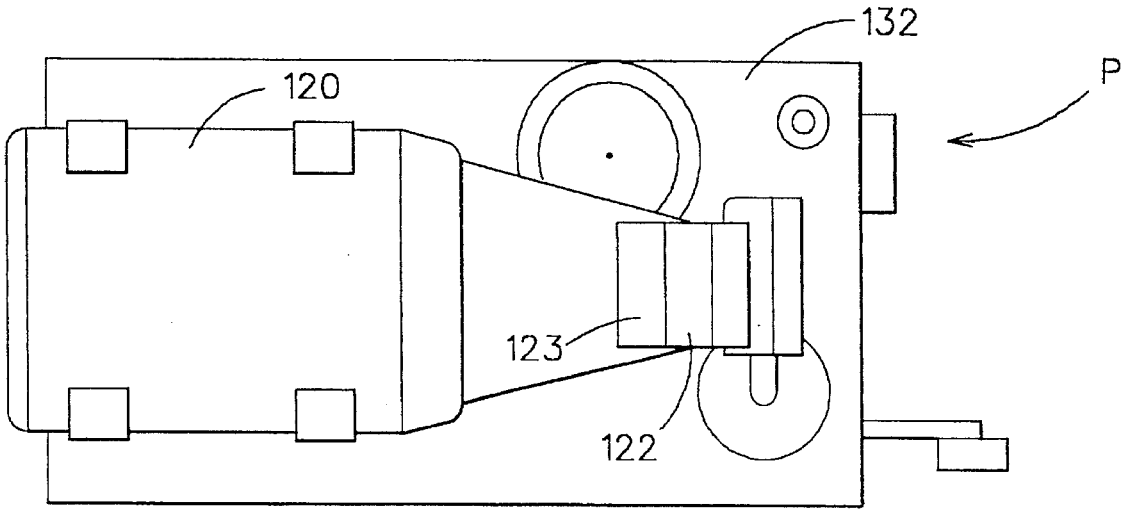
FIG. 8 is a top plan view of the hydraulic pump assembly of the invention.
Figure 9:
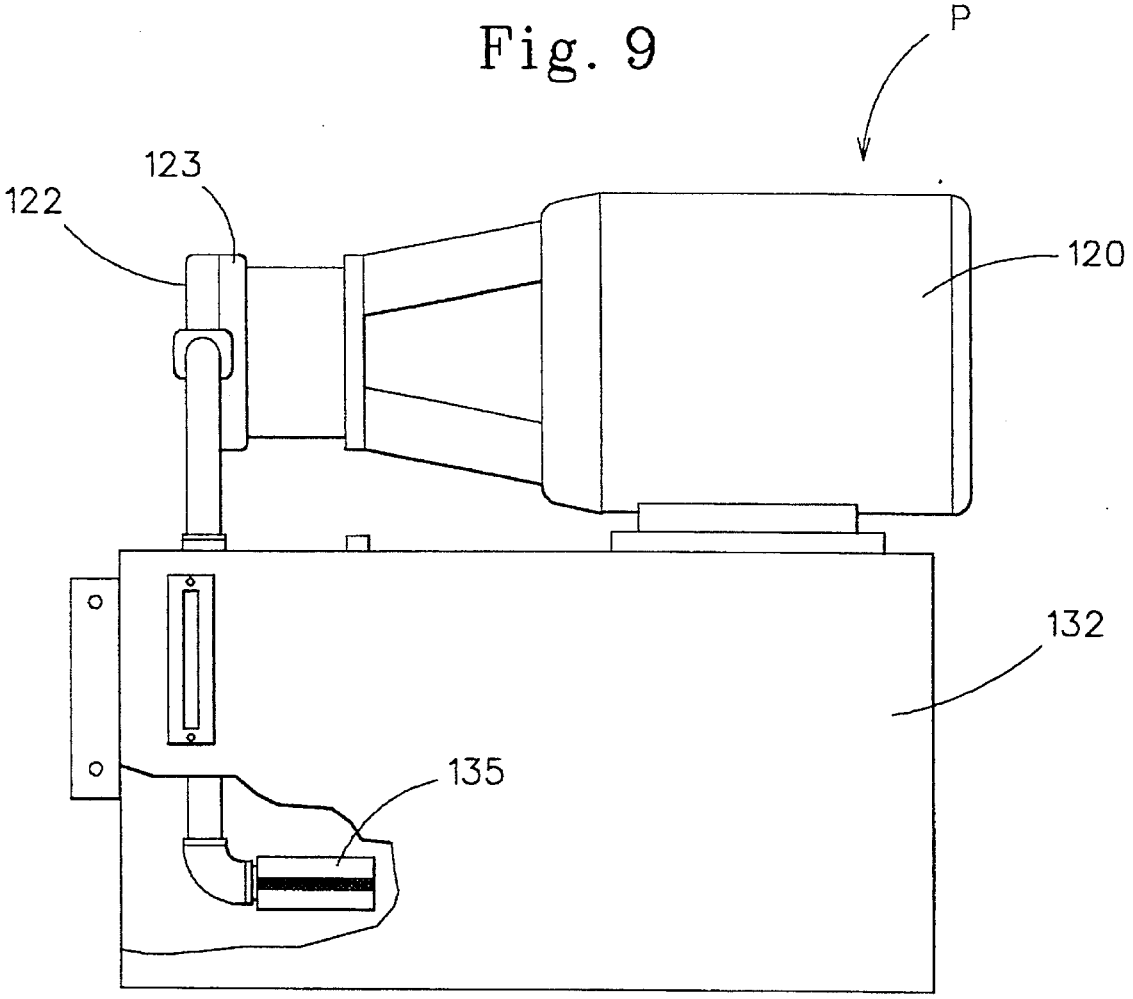
FIG. 9 is an elevational view of the hydraulic pump assembly of FIG. 8.

The hydraulic pump assembly P, as illustrated in FIGS. 8 and 9, includes reservoir 132 to which pumps 122 and 123 and motor 120 are secured. We prefer that the pump assembly P be an integral unit, so that same may be mounted on either the left or right side of compactor assembly C, as may be appropriate for a given application. Because the hydraulic pump assembly P is an integral unit, then installation of same is relatively simple to accomplish, and merely requires that the hydraulic hoses be appropriately installed. The pumps each have an output of 65 p.s.i., with the motor having an output of 15 hp. While we prefer an hydraulic drive for motor and gear box assembly 96, other drives, such as geared or chained assemblies, are useable.

The axis of rotation of shaft 50 is vertically disposed above the axis of motion defined by piston 40 of cylinder 42. We prefer that the floor 102 be above the floor 36 of drop area 100, because broken material falling from the floor 102 into drop area 100 thereby is moved out of the way of material being transported by continued rotation of auger A. Drop area 100 therefore provides for broken material to be accumulated during operation.

Because floor 102 is above floor 36, then we minimize the tendency of material being transported by the auger A from backing up in receiving chamber R. The axis of rotation of the shaft 50 is parallel to the axis of motion defined by the piston 40 of cylinder 42 to facilitate the transport of material from receiving chamber R into the drop area 100 and ultimately to container U. The parallel axes of the shaft 50 and the piston 40 furthermore are beneficial because material broken toward the rearward portion of auger A need not normally be further broken, as could occur if the shaft 50 were angled to cause the helix 52 to follow the floor 102. We do not believe it necessary to break the material into extremely small pieces as would occur should the helix 52 follow the floor 102, because additional size reduction likely will not achieve substantially greater compaction density. Also, because the axes 50 and 40 lie on a vertical plane, then the compactor assembly C is relatively compact, minimizing space requirements for its installation.

Operation and use of the compactor assembly C is relatively straightforward because of the simplicity of the hydraulic control system operating the ram 38 and the auger A. In use, material to be compacted is deposited into receiving chamber R through the open top of the housing of the compactor assembly C. The shaft 50 is rotated by flow of hydraulic fluid to motor and gear box assembly 96, with the result that the helix 52 engages the material and begins to transport same toward breaker plate 110 and surface 112 while at the same time causing the material to be broken by engagement with the helix 52. Should the material cause rotation of shaft 50 to stall, or should the helix 52 fail to grasp the material, then the rotation imparted to shaft 50 by motor and gear box assembly 96 may be reversed by appropriate actuation of a control button operating directional control valve 126. While counterrotation will have the tendency of moving the material toward the rear of receiving chamber R, rotation can subsequently be returned to the clockwise orientation. As the material is broken and falls to floor 102, then same continues to be transported by the rest of the mass toward drop area 100 and surface 112. The broken material then falls into drop area 100, with additional material continuing to be moved by helix 52.

Hydraulic fluid is continuously directed to cylinder 42 to reciprocate the packer ram 38, so that material in drop area 100 is moved through the opening in the forward area of drop area 100, as defined by the spaced front supports 106 and 108, and to the container U. Movement of the packer ram 38 to the forward position of FIG. 2A causes the material accumulated in drop area 100 to be transported through the opening defined by front supports 106 and 108 and breaker plate 110 into the container U. The packer ram 38 is then retracted to the position of FIG. 2. Because of plate 48, then extension of ram 38 to the forwardmost position does not result in material being deposited behind the ram plate 46.

The forward end portion of compactor assembly C preferably has standard dimensions in order to fit a standard container U. Thus, essentially any container U may be used with the invention, substantially enhancing its utility.

While this invention has been described as having a preferred design, it is understood that it is capable of further modifications, uses, and/or adaptations, following in general the principle of the invention, and including such departures from the present disclosure as come within known or customary practice in the art to which the invention pertains, and as may be applied to the essential features set forth herein, and fall within the scope of the invention limited by the appended claims.

What we claim is:

1. A compactor assembly, comprising:

a) a ground supported housing with a receiving chamber having an open top through which waste material is deposited;

b) an auger rotatable on an axis positioned within said housing for breaking waste material received therein through said open top and for transporting the waste material;

c) a drop area downstream of said receiving chamber for receiving transported waste material and having a remote open portion, said auger having a portion aligned with and disposed above said drop area;

d) a compactor ram reciprocal on an axis parallel to said auger axis for transferring waste material through said open portion;

e) a first drive operably associated with said auger for rotating said auger; and f) a second drive operably associated with said compactor ram for reciprocating said compactor ram.

2. The compactor assembly of claim 1, wherein:

a) said auger axis and said compactor ram axis lie on a common plane.

3. The compactor assembly of claim 2, wherein:

a) said plane is vertically disposed.

4. The compactor assembly of claim 3, wherein:

a) said auger axis is spaced above said compactor ram axis.

5. The compactor assembly of claim 1, wherein:

a) said compactor ram has a first retracted position, and a second extended position juxtaposed to said open portion.

6. The compactor assembly of claim 5, wherein:

a) said auger has first and second terminal end portions, and said second terminal end portion is juxtaposed to said open portion.

7. The compactor assembly of claim 6, wherein:

a) said auger first terminal end portion is supported by said housing.

8. The compactor assembly of claim 7, wherein said receiving chamber includes:

a) an upper portion and a lower portion; and b) said compactor ram reciprocates along said lower portion.

9. The compactor assembly of claim 8, wherein:

a) said auger is disposed above said compactor ram.

10. The compactor assembly of claim 1, wherein:

a) each of said first and second drives is an hydraulic motor.

11. The compactor assembly of claim 10, wherein:

a) said first drive is a rotary motor; and b) said second drive is a cylinder and piston assembly.

12. The compactor assembly of claim 11, wherein:

a) a common hydraulic fluid supply communicates with each of said drives.

13. The compactor assembly of claim 12, wherein:

a) a controller is operably associated with said fluid supply for continuously supplying hydraulic fluid to said first and second drives.

14. The compactor assembly of claim 1, wherein said auger includes:

a) a shaft having a first terminal end supported by said housing; and b) a continuous substantially helical cutter disposed about and rotatable with said shaft for breaking waste material and transporting the waste material within said receiving chamber.

15. The compactor assembly of claim 14, wherein:

a) said cutter extends above said open top.

16. The compactor assembly of claim 15, wherein said housing includes:

a) a rear wall; and b) said shaft is journaled to said rear wall.

17. The compactor assembly of claim 16, wherein:

a) said cutter extends along said shaft from said rear wall through said open portion.

18. The compactor assembly of claim 17, wherein:

a) said cutter has a first diameter at said rear wall and a second smaller diameter at said open portion.

19. The compactor assembly of claim 18, wherein:

a) said diameter decreases along said shaft.

20. The compactor assembly of claim 14; wherein:

a) said first drive is coaxial with said shaft.

21. The compactor assembly of claim 20, wherein:

a) said first drive includes an hydraulically rotated motor and a cooperating gear box.

22. The compactor assembly of claim 20, wherein:

a) a bearing assembly is secured to said housing and has an opening in which said shaft is journaled; and b) said first drive is secured to said bearing assembly.

23. The compactor assembly of claim 22, wherein:

a) a support assembly is secured to said housing and extends therefrom adjacent said bearing assembly; and b) said first drive is secured to said support assembly.

24. The compactor assembly of claim 22, wherein:

a) said bearing assembly is a composite sleeve disposed about said shaft.

25. The compactor assembly of claim 14, wherein:

a) said shaft has a first portion positioned within said housing and a second portion exterior thereof.

26. The compactor assembly of claim 1, wherein:

a) a container is secured to said housing and is in communication with said open portion for receiving waste material transferred therethrough by said compactor ram.

27. The compactor assembly of claim 26, wherein:

a) said open top is rectangular; and b) said open portion is generally rectangular.

28. The compactor assembly of claim 1, wherein:

a) a controller is operably associated with said first and second drives for causing said drives to simultaneously continuously operate.

29. A compactor assembly, comprising:

a) a ground supported housing having an open top and a receiving chamber;

b) an auger rotatable on an axis for breaking material deposited into said receiving chamber through said open top and for transporting deposited material therethrough, said auger comprising a shaft and a helix secured to and rotatable with said shaft;

c) a drop area downstream of said receiving chamber and communicating therewith, said auger having a portion aligned with and disposed above said drop area;

d) a compactor ram operably associated with said drop area and reciprocal therein for transferring material therefrom;

e) a first drive operably associated with said shaft for causing rotation thereof; and f) a second drive operably associated with said compactor ram for causing reciprocation thereof.

30. The compactor assembly of claim 29, wherein:

a) said helix tapers along said shaft.

31. The compactor assembly of claim 30, wherein:

a) said helix has a diameter in said drop area which is less than the diameter in said receiving chamber.

32. The compactor assembly of claim 31, wherein:

a) said shaft and said helix extend beyond said housing.

33. The compactor assembly of claim 29, wherein:

a) said shaft has a first end rotatably secured to said housing.

34. The compactor assembly of claim 29, wherein:

a) said shaft has a first end rotatably secured to said housing and a second end extending beyond said housing; and b) said auger has a first diameter at said first end and a second diameter at said second end, said first diameter exceeding said second diameter.

35. The compactor assembly of claim 34, wherein:

a) a composite cylindrical bearing rotatably secures said shaft to said housing.

36. The compactor assembly of claim 35, wherein:

a) said shaft is disposed above said compactor ram.

37. The compactor assembly of claim 29, wherein:

a) a container is releasably secured to said receiving chamber for receiving material therefrom.

38. The method of breaking and compacting bulky materials, comprising the steps of:

a) providing a compactor assembly comprising a rotary auger for breaking and transporting material contacted therewith, a drop area for receiving the broken material, a reciprocating ram operably associated with the drop area for discharging the broken material, and a container in which the broken material is thereafter received for compaction by reciprocation of the ram;

b) contacting the rotating auger with material and thereby causing the material to be broken;

c) transporting the broken material to the drop area by continued rotation of the auger; and d) continuously reciprocating the ram as the auger is rotated and thereby discharging the broken material to the container.

39. A compactor assembly, comprising:

a) a ground supported housing with a receiving chamber having an open top through which waste material is deposited;

b) an auger rotatable on an axis positioned within said housing for breaking waste material received therein through said open top;

c) a drop area downstream of said receiving chamber for receiving waste material and having a remote open portion;

d) a compactor ram reciprocal on an axis parallel to said auger axis for transferring waste material through said open portion;

e) a first drive operably associated with said auger for rotating said auger;

f) a second drive operably associated with said compactor ram for reciprocating said compactor ram; and g) a container secured to said housing and in communication with said open portion for receiving waste material transferred therethrough by said compactor ram.

* * * * *